US007992499B2

(12) United States Patent
Salignon et al.

(10) Patent No.: US 7,992,499 B2
(45) Date of Patent: Aug. 9, 2011

(54) DEVICE FOR NEUTRALIZING AND DESTROYING BUILDINGS FOR STORING NOXIOUS SUBSTANCES

(75) Inventors: Denis Salignon, Orleans (FR); Henri Ropars, Orleans (FR); Alain Dousset, Ingre (FR); Karine Thoral-Pierre, Neung sur Beuvron (FR)

(73) Assignee: TDA Armements SAS (FR)

( * ) Notice: Subject to any disclaimer, the term of this patent is extended or adjusted under 35 U.S.C. 154(b) by 31 days.

(21) Appl. No.: 12/158,460

(22) PCT Filed: Dec. 7, 2006

(86) PCT No.: PCT/EP2006/069431

§ 371 (c)(1),
(2), (4) Date: Dec. 1, 2008

(87) PCT Pub. No.: WO2007/071570

PCT Pub. Date: Jun. 28, 2007

(65) Prior Publication Data

US 2009/0090265 A1 Apr. 9, 2009

(30) Foreign Application Priority Data

Dec. 23, 2005 (FR) ..... 05 13222

(51) Int. Cl.
*F42B 12/58* (2006.01)

(52) U.S. Cl. ..... 102/489; 102/519

(58) Field of Classification Search ..... 102/489, 102/517, 519; 89/1.11, 1.1
See application file for complete search history.

(56) References Cited

U.S. PATENT DOCUMENTS

| | | | | |
|---|---|---|---|---|
| 1,363,578 | A | 12/1920 | Edwards | |
| 4,922,826 | A | 5/1990 | Busch et al. | |
| 6,849,140 | B2 * | 2/2005 | Thiesen et al. | 149/19.5 |
| 6,945,175 | B1 | 9/2005 | Gotzmer et al. | |

FOREIGN PATENT DOCUMENTS

| | | |
|---|---|---|
| DE | 19948710 | 4/2001 |
| FR | 2771499 | 5/1999 |

* cited by examiner

*Primary Examiner* — James S Bergin
(74) *Attorney, Agent, or Firm* — Lowe Hauptman Ham & Berner, LLP

(57) ABSTRACT

The invention relates to the field of penetrative projectiles capable of penetrating buildings whose structures are reinforced such as anti-aircraft shelters for example. The invention consists in a projectile comprising a solid penetrative body designed to perforate a wall of the building, the roof for example. Inside the projectile according to the invention are housed sub-munitions enclosing the charge in the form of bomblets, a device for plugging the hole formed in the wall by the passage of the projectile, and a sequencing and command device. When the wall is penetrated, the rear portion of the penetrative body is separated from the rest of the penetrative body and the plugging device is deployed so as to block the hole that has been passed through. After penetration, the front portion of the penetrative body continues its route toward the ground while the sub-munitions enclosing the bomblets remain suspended in the air under the wall.

13 Claims, 5 Drawing Sheets

DEVICE FOR NEUTRALIZING AND DESTROYING BUILDINGS FOR STORING NOXIOUS SUBSTANCES

CROSS-REFERENCE TO RELATED APPLICATIONS

The present Application is based on International Application No. PCT/EP2006/069431, filed on Dec. 7, 2006, which in turn corresponds to French Application No. 051322, filed on Dec. 23, 2005, and priority is hereby claimed under 35 USC §119 based on these applications. Each of these applications are hereby incorporated by reference in their entirety into the present application.

FIELD OF THE INVENTION

The invention relates to the field of producing projectiles intended to penetrate a construction, a building, so as to destroy objects contained in this construction, while minimizing the damage caused to the construction itself.

BACKGROUND OF THE INVENTION-PRIOR ART

Modern conflicts sometimes bring into play chemical or bacteriological munitions enclosing substances that are usually stored in containers. These containers are usually, for evident reasons of security, stored separately from the military charges contained in the cargo vehicle, a missile for example. These substances are manufactured and warehoused in appropriate premises that are sometimes, for strategic reasons, located in the middle of or close to urban zones, populated by civilians. Then, when it is sought to destroy manufacturing and/or storage units, in which noxious substances are warehoused, in containers for example, one of the important preoccupations is to be capable of destroying these units and/or their content without the latter being propagated outside. This is to prevent contaminating the civilians that may be in the vicinity of the building.

In order to destroy storage elements, such as containers, warehoused in a building, use is usually made of perforating projectiles, whose role consists in passing through a wall of said building, usually the roof, so that a destructive charge can penetrate the interior. For reasons of effectiveness, the charge carried by the projectile is distributed, in a known manner, in sub-munitions of smaller size, themselves consisting of bomblets, designed to be thrown in different directions and from different heights, from the point at which the projectile enters the building. Each bomblet then explodes expelling perforating elements, fragments of metal for example, whose action consists in perforating the walls of the containers in order to empty them of their content.

To obtain considerable effectiveness, it is necessary to be able to ensure an optimum dispersion of the bomblets in the storage space of the containers. Furthermore, to be able to ensure the protection of the surrounding populations against the possible risks of contamination, it is necessary that the explosions of the bomblets occur so that the latter destroy the containers without the structure and seal of the building being affected. This control of the effect of the various explosions is the result in particular of controlling the height at which each bomblet or each group of bomblets must be ejected from the projectile payload and the moment of explosion of each bomblet after ejection.

On the one hand, if consideration is given to a projectile whose perforating action is due only to the kinetic energy that it has, it is noted that, according to the nature of the building in question, the impact energy necessary to perforate the roof varies considerably. Specifically, if the target attacked is a production unit, a factory for example, in which individuals are required to spend time during their working hours, the building enclosing the containers is a building of the industrial type whose roof is a thin wall that is easy to pass through. On the other hand, in the case of a storage unit, the user is usually dealing with a structure that is well protected against projectiles, of the shelter type for example whose roof usually consists of a thick concrete slab that usually has no openings.

Then, the problem that is posed, when the user wishes to construct a multipurpose projectile, is associated with the difference of kinetic energy absorption that the projectile sustains depending on whether it is passing through a roof of the industrial building type or a thick roof of the storage building type. Specifically, such a projectile must be able to benefit, at the moment of contact with the wall to be passed through, from a sufficient kinetic energy to be able to pass through the thickest walls. Such a kinetic energy is for example obtained when the projectile comes into contact with the wall, the roof, with a speed of the order of 300 m/s. In this way, when the wall to be perforated is a thick wall, the kinetic energy of the projectile is largely absorbed when passing through. The projectile then continues its course inside the building with a reduced speed which leaves the time to continue with the sequenced ejection of the various bomblets. On the other hand, when the wall to be perforated is a thin wall, such as an industrial building roof for example, the kinetic energy of the projectile is not absorbed by passing through. The projectile then continues its course inside the building at full speed and buries itself very deep in the ground even before the bomblet-dispersion sequence has been able to be controlled and even sometimes applied.

Furthermore, the perforation of the roof of the building enclosing the substances to be destroyed poses a problem of sealing against the outside. Specifically, the dispersed substances may be eminently volatile and therefore be capable of leaving the enclosure that the building constitutes through the penetration orifice, to be dispersed over the neighboring populations.

To solve the problem posed by the speed of penetration of the projectile, an existing solution consists in using less perforating projectiles having for example less weight, and in equipping these projectiles with additional projectiles (mini rockets) capable of destroying the wall, thin or thick, to be passed through. Therefore, the projectile penetrates the building more slowly, which makes it possible to increase the volume reserved for the sub-munitions and to minimize the stresses sustained by the latter. Accordingly, the additional projectiles are fired when the perforating projectile comes close to the wall.

This solution, certainly more costly and more difficult to apply than the solution consisting in using a high kinetic energy projectile, is however overall more effective. On the other hand, it in no way solves the problem of sealing posed by the formation of a hole in the wall or the roof through which the projectile has penetrated the building and neither does it solve the problem associated with an optimal dispersion of the bomblets.

DESCRIPTION OF THE INVENTION

One purpose of the invention is to propose a simple solution making it possible to solve simultaneously the dual problem consisting in defining a projectile that is suitable both for buildings of the storage shelter type, having a reinforced roof, and buildings of the industrial type; and ensuring that the noxious products contained in the building are not dispersed outside.

Accordingly, the subject of the invention is a penetrating projectile releasing, after penetration, sub-munitions from which bomblets are ejected which, after detonation, generate perforating fragments, this projectile comprising in particular a solid penetrative body in which at least one sub-munition is placed enclosing bomblets with perforating fragments, and an assembly sequencing and command device, controlling the dispersion and firing of the bomblets.

According to the invention, the penetrative body also comprises:

- an ejectable rear portion also comprising, in a characteristic manner, a jacket body, fixedly attached to the ejectable penetrative body, and enclosing:
- a device for separating this rear portion from the front portion of the penetrative body, whose application is commanded by the sequencing and command device,
- a device for plugging the entry orifice fixedly attached to the rear portion of the penetrative body,
- suspension elements making it possible to link the assembly consisting of the sub-munition enclosing the bomblets and the device for sequencing and dispersing the bomblets to the rear portion of the penetrative body, and to keep this assembly suspended above the ground.

According to a variant embodiment, the projectile according to the invention also comprises a set of mini-rockets, fired close to the wall to be perforated and intended to destroy the material forming the wall in the penetration zone before the penetration of the projectile. The penetrative body no longer being responsible for destroying the material forming the wall, it may therefore be advantageously lightened. This weight gain makes it possible to carry a bigger load.

According to one embodiment of the invention, the device for separating the rear portion from the penetrative body is a pyrotechnic fuse placed on the periphery in the junction zone.

According to one preferred embodiment, the device for plugging the entry orifice is a balloon that can be inflated like an airbag, kept pressed on the orifice by the weight of the elements of the projectile remaining in suspension.

In this preferred embodiment, the rear portion of the penetrative body lines the penetration orifice so as to protect the base of the balloon from any protruding portions.

According to one variant embodiment, the device for plugging the entry orifice is an inflatable balloon having substantially a plug-shape.

According to another variant embodiment, the device for plugging the entry orifice is an inflatable balloon having a central portion and extensions in the form of petals uniformly distributed about the central portion.

According to a preferred embodiment, as the projectile according to the invention comprises two sub-munitions, the sequencing and command device carries out a sequential dispersion of the bomblets housed in one and the same sub-munition, the two sub-munitions being activated separately in sequence.

According to a variant embodiment, certain bomblets are placed in reserve in order to be activated in a second phase following the phase for activating the other bomblets.

The main advantage of the projectile according to the invention is that it has an effectiveness that is independent of the thickness of the wall passed through, the payload no longer sustaining a deceleration during the penetration phase.

According to the invention, the dispersible explosive elements are kept suspended, without undergoing acceleration, until they are dispersed. This dispersion may therefore advantageously be carried out with maximum effectiveness in a predictable and reproducible manner.

The dispersion and sequential firing of the various bomblets advantageously makes it possible to limit the risks of simultaneous explosions which could damage the building and compromise the safety of the populations outside.

In addition, the presence of bomblets placed in reserve and dispersed after the other bomblets advantageously makes it possible to prevent any attempt at sheltering the storage elements that have not been damaged by the bomblets already dispersed and fired.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

DESCRIPTION OF THE FIGURES

The present invention is illustrated by way of example, and not by limitation, in the figures of the accompanying drawings, wherein elements having the same reference numeral designations represent like elements throughout and wherein.

DETAILED DESCRIPTION OF THE INVENTION

Figure 1:
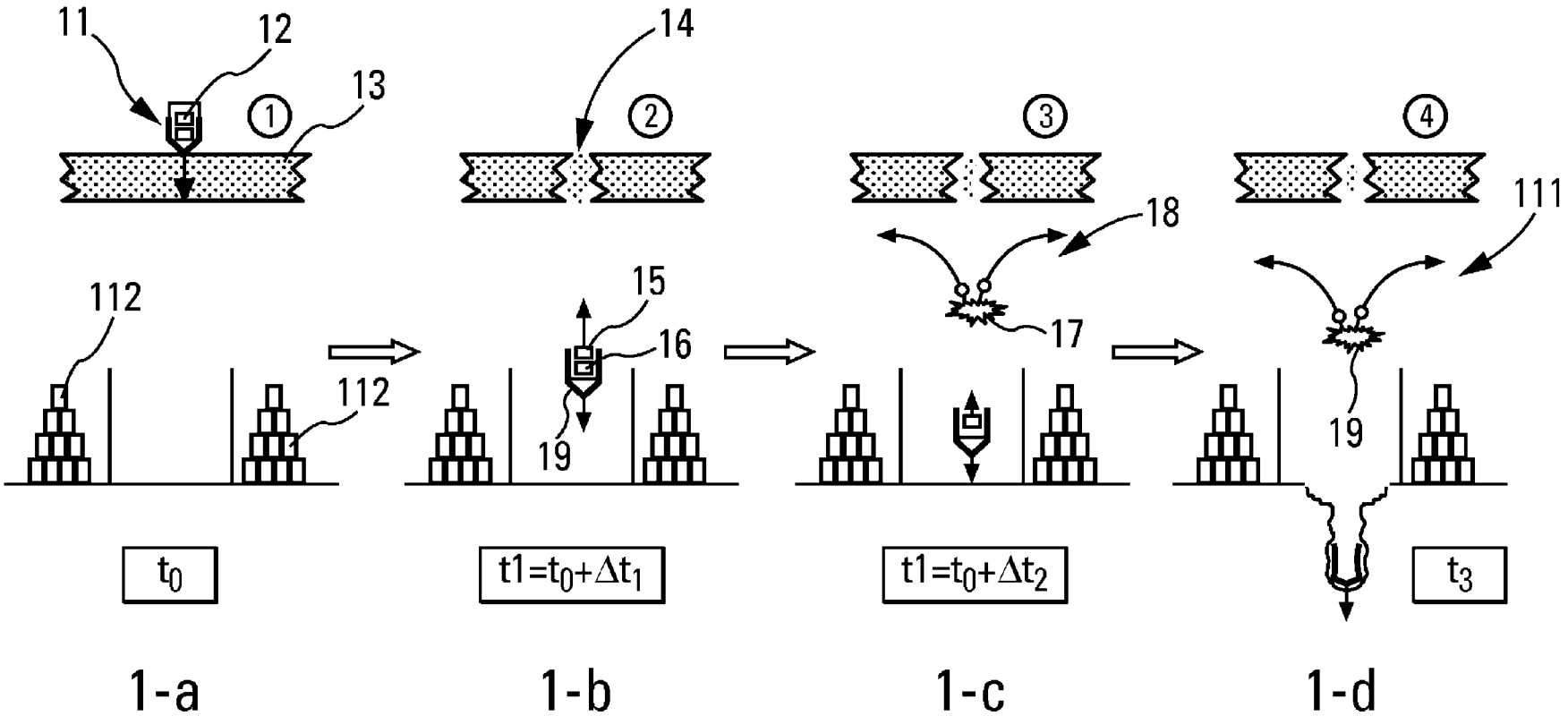
Fig. 1 Prior Art
FIG. 1, an illustration of the behavior of a conventional projectile, known in the prior art, penetrating a building of the shelter type with reinforced walls, FIG. 2, an illustration of the behavior of the same projectile penetrating a conventional industrial building with unreinforced walls, FIGS. 3 to 5, illustrations presenting the projectile according to the invention, and its behavior when it penetrates any building, FIG. 6, a representation in a top view of the device for plugging the entry orifice, in a preferred embodiment.
Figure 2:
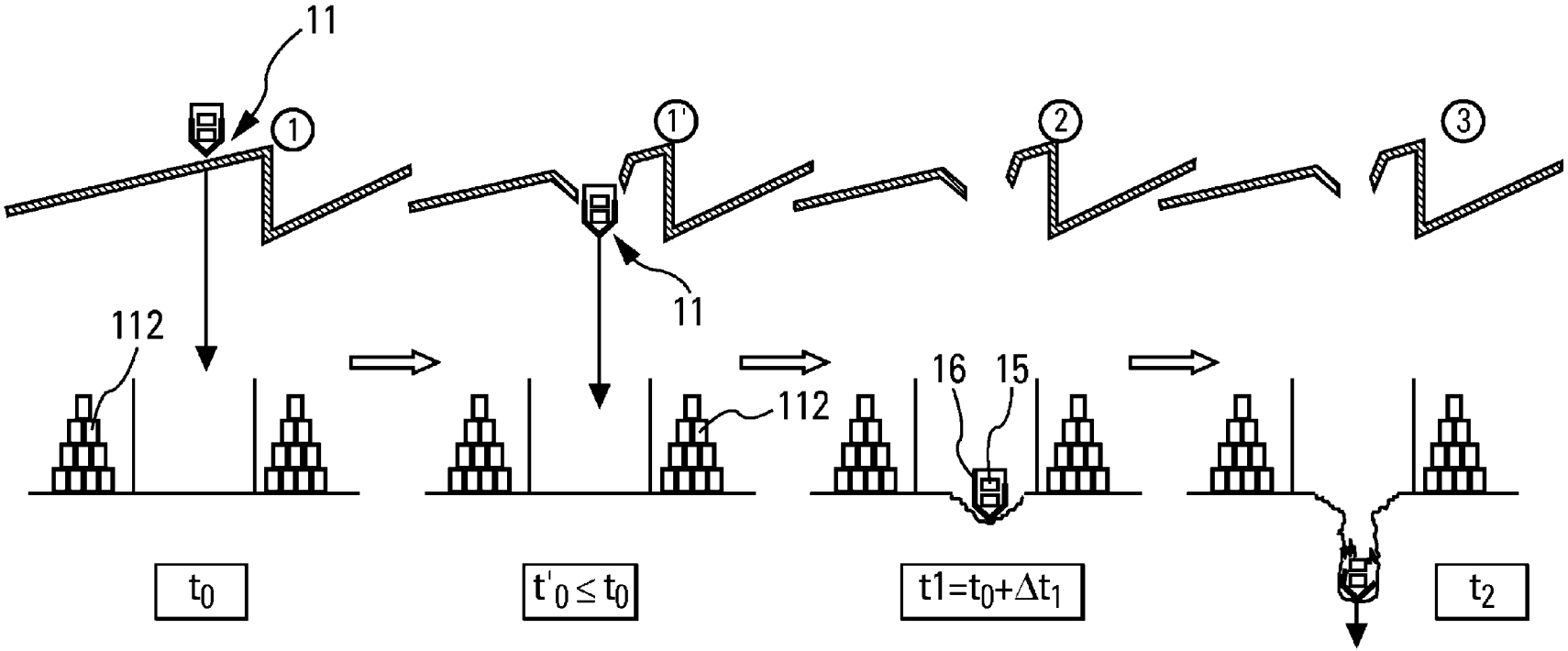
Fig. 2 Prior Art

FIGS. 1 and 2 are dealt with first.

In order to destroy noxious products stored in containers 112, in the manufacturing or storage phase, perforating projectiles are routinely used. The purpose of these projectiles is to penetrate structures forming the building enclosing these products. "Structure" means both the walls and the roof. To do this and because the nature of these structures is by definition not well known, the projectile used, a bomb for example, is usually designed so that it can pass through a wall, even a reinforced wall, merely because of its kinetic energy. This is why the projectiles generally used are projectiles having a considerable weight, 200 to 300 kg for example, which reach their objective with a very high speed, of the order of the speed of sound. A large portion of this weight is represented by a solid penetrative body 11 enclosing on its rear portion the payload 12 which is used to destroy the stored products.

In a conventional manner, the operation of such a projectile may be broken down into three phases, a phase of approaching the building, a phase of perforating the wall, usually the roof, and a phase of movement inside the building until the projectile crashes into the ground.

Although, for a projectile whose weight and speed have been correctly computed, the phase of perforating the partition poses no particular problem irrespective of the partition passed through, the same does not apply to the phase of movement inside the building. This is because, during this phase, various actions have to be taken in a precise manner and at precise moments. These actions consist mainly in the release of the sub-munition(s), the sequential ejection of the bomblets, sub-munition by sub-munition. They must be accomplished so that the bomblets transported can be dispersed evenly throughout the space of the building. For this, the bomblets must be distributed from a point situated as high as possible inside the building. In order to calculate the optimum moment of release of the load, the onboard control unit in the projectile usually takes as the reference moment the moment $t_0$ when the wall is passed through. This moment is furthermore conventionally identified simply by the change in acceleration that the projectile sustains at the moment of passing through. This change may be measured, in a known manner, by means of an accelerometer onboard the projectile.

In the case of a reinforced building, of the shelter type, this sudden change of acceleration is substantial, the projectile having to pass through a considerable thickness of partition. The moment when this change is sensed may therefore be easily determined and may therefore be used as the origin of the times for sequencing the operations of the next phase. In addition, the deceleration sustained by the projectile promotes the on-time accomplishment of the actions of releasing the sub-munitions and ejecting the bomblets.

In the case of a standard building, of the industrial type, the walls, and in particular the roof, are thin. A projectile dimensioned to pass through any structure passes through them without difficulty and without sustaining notable deceleration. That is when the problem is posed of sequencing, based on an origin moment $t_0$ that is difficult to determine and for a projectile not having sustained any notable deceleration, the actions of release and firing of the load.

FIGS. 1 and 2 illustrate the change of behavior of a given projectile depending on whether it penetrates a reinforced building (FIG. 1) or an ordinary industrial building (FIG. 2).

FIG. 1 illustrates the behavior of a conventional projectile penetrating a building with reinforced structures, such as a shelter for storing chemical products for example. In the figure, the projectile, as is usually the case, follows a trajectory which causes it to penetrate the building through the roof 13 which, being a building with reinforced structures, consists for example of a concrete slab 30 to 40 cm thick.

As shown in the figure, the projectile 11 makes contact with the roof 13 at the moment $t_0$, at high speed, of the order of 330 m/s. Since it is a reinforced structure, the projectile at this moment sustains a sudden deceleration, while a through-orifice 14 is created in the impact zone. The projectile thus greatly decelerated then continues its course toward the ground, along a trajectory that remains substantially vertical. Its speed, which depends on the deceleration sustained on impact, is then substantially equal to 150 m/s for example. Being a building of the storage shed type, the distance traveled by the projectile before the ground is typically of the order of 7 to 10 meters.

In a conventional perforating projectile, the great deceleration sustained is recorded by an accelerometer and is rapidly registered at a moment close to $t_0$ by the management device onboard the projectile. The latter may then initialize the timing of the operations to release and fire the load.

In the example illustrated by the figure, the load 12 is divided into two separate sub-munitions 15 and 16 containing respectively the loads 17 and 19 consisting of bomblets for example that are released at different moments, $t_0+\Delta t_1$ and $t_0+\Delta t_2$.

To allow an effective dispersion of the load, each sub-munition is expelled from the body of the projectile with a rearward acceleration designed to allow it to rise to the optimum height to disperse the load that it contains. This acceleration must in particular be sufficiently great to cancel out the speed of fall of the projectile. To ensure an optimum effect, the loads 17 and 19 are dispersed obliquely in the form of projectile showers 18 and 111.

After release of the sub-munitions, the body 19 of the projectile continues its course and penetrates the ground.

As can be noted through the illustration of FIG. 1, the correct operation of such a projectile is conditional upon the prior determination of the thickness and the strength of the wall encountered by the projectile and, to a lesser extent, of the estimate of the height of the building. This is because this determination governs the estimate of the deceleration sustained by the projectile and the speed of movement of the latter inside the building. Therefore, for a given strength, the speed of movement of the projectile after penetration has a determined value which governs the value of the time intervals $\Delta t_1$ and $\Delta t_2$ after which the sub-munitions 15 and 16 are released to obtain an optimal dispersion of the load. The determination of $\Delta t_1$ and $\Delta t_2$ is usually the result of a compromise designed to obtain a satisfactory effectiveness for a wall made of a given type of material and whose thickness is in a given range, for example a wall made of concrete whose thickness is between 30 and 60 centimeters.

A projectile with features thus predefined is totally appropriate for destroying noxious products stored in a building with reinforced structures. On the other hand, if the assumptions having led to the determination of the moments $\Delta t_1$ and $\Delta t_2$, and in particular if the roof of the building passed through is too thin to cause a significant deceleration of the projectile on impact, then the projectile is largely ineffective. FIG. 2 illustrates such a situation by showing the movement of the projectile 11 from its arrival in contact with the building until it reaches the ground.

At the moment $t_0$, the projectile strikes the relatively thin partition forming the roof of the building and perforates it virtually instantaneously ($t'_0 \# t_0$), without undergoing a notable deceleration. It then continues its descent inside the building at full speed. The accelerometer onboard the projectile not having registered any substantial deceleration, due to the weak resistance of the roof that has been passed through, no sequence of releasing the sub-munitions has been initialized from $t'_0$, so that at a moment $t'_1$ the projectile still fitted with its sub-munitions 15 and 16 strikes the ground where it terminates its course at a moment $t'_2$ without having fulfilled its function.

As can be ascertained through the illustrations of FIGS. 1 and 2, it is therefore difficult to design a perforating projectile operating in a simple, effective manner both against a reinforced building and against a conventional industrial building. Consequently, to ensure satisfactory results irrespective of the type of building housing the stock of noxious products that it is being sought to destroy, the user is required to make the projectile control unit more complex. A known solution consists for example in adding to the projectile a sensor allowing it to detect the distance separating it from the wall to be passed through and to determine, according to its speed, the moment $t_0$ that it passes through the wall.

Then, if at $t_0$ no deceleration occurs, the projectile control unit is nevertheless capable of initiating the sequence to release the sub-munitions and ejection and firing of the bomblets, by also taking account of the fact that the speed of the projectile has not reduced. However, this solution, although effective, has the main disadvantage of making more complex the control function that must both acquire capabilities of measuring closeness and ensuring a sequencing that varies depending on the nature of the partition perforated in order to adapt to the speed of propagation of the projectile inside the building. The overall consequence of this is to make the manufacture of the projectile more complex and therefore less reliable and more costly.

The illustrations of FIGS. 1 and 2 furthermore make it possible to ascertain that the use of a conventional perforating projectile, known in the prior art, provides no evident effective solution to the problem of keeping the building sealed after the penetration of the projectile.

Secondly, attention is given to FIGS. 3 to 6 which illustrate the description of the perforating projectile according to the invention.

Figure 3:
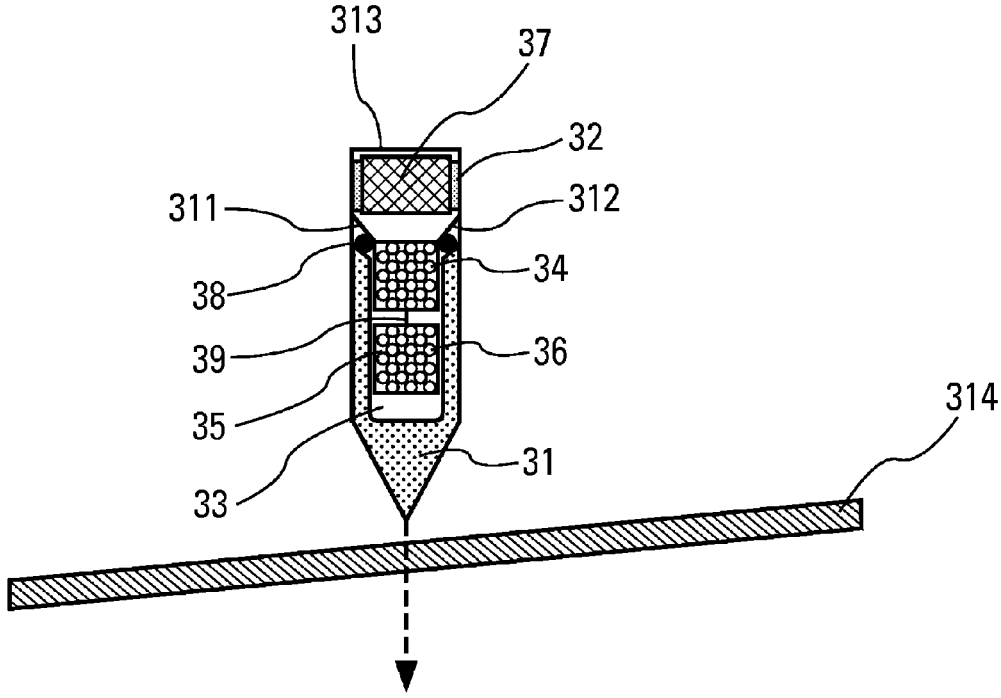

FIG. 3 represents schematically the structure of the projectile according to the invention before it collides with the wall to be perforated.

As FIG. 3 illustrates, the projectile according to the invention mainly comprises a penetrative body 31, itself comprising a rear portion 32. In the space constituted by the cavity 33 formed inside the penetrative body are housed sub-munitions 34 and 35 enclosing individual loads 36 or bomblets, a plugging device 37 situated right at the rear of the projectile and a sequencing and command device, not shown in the figure. The projectile according to the invention also comprises a device 38 making it possible to separate the rear portion 32 from the whole of the penetrative body.

According to the invention, the sub-munitions 34 and 35, the sequencing and command device and the plugging device 37 are kept fixedly attached to the rear portion 32, the sub-munitions being connected to the plugging device by conventional suspension means, not described here, and symbolized in the figure by the lines 39, 311 and 312.

Again according to the invention, the plugging device 37 consists of an inflatable element designed to be deployed at the rear of the projectile, the rear face 313 of the rear portion 32 of the penetrative body being designed to open or else to be ejected, under the pressure following the expansion of this inflatable element.

The projectile according to the invention is also fitted with means for measuring proximity, a miss distance indicator for example, allowing it to determine its distance relative to the wall 314 that is on its trajectory, and the moment $t_0$ of impact. These known measurement means furthermore are not shown in the figure.

Figure 4:
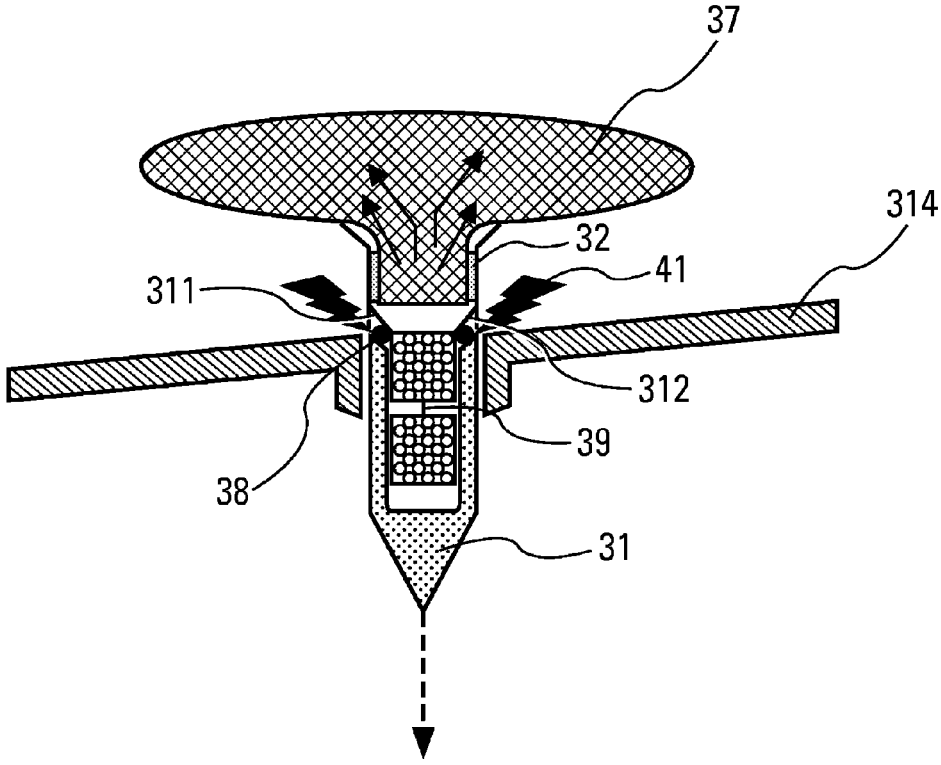

The present FIG. 4 describes schematically all the operations that take place inside the projectile a few ms after the moment of impact on the wall 314. At this moment, the projectile is passing through the partition 314, the front portion already being inside the building while the rear portion is still on the outside.

At this moment, the synchronization and command device activates the plugging device 37 and the separation device 38.

The plugging device consists of an inflatable element, or balloon, able to take for example the form of a plug, whose inflation is for example carried out ultra-rapidly by means of a detonating cartridge like a protective cushion used in the automobile industry and better known as an airbag. After inflation, the base of the device closes off the orifice created in the partition 314 by the projectile passing through.

A second usage of the plugging device is to keep in suspension the rear portion of the penetrative body, still connected to the sub-munitions before ejection of the bomblets. Accordingly, it is for example fixedly attached to the rear portion 32 of the penetrative body, to which are attached the elements 39, 311 and 312 for suspending the sub-munitions 34 and 35 and the synchronization and command device. Therefore, once the plugging device has been deployed, the loads are held, before dispersion, at a height allowing their dispersion and their firing in an optimal manner.

The maintenance in suspension is made possible by the action of the separation device 38 which separates the sub-munitions 34 and 35 and the synchronization and command device from the front portion 31 of the penetrative body which continues its course. The separation is achieved by separating the rear portion 32 from the rest of the penetrative body that is more solid by making a cut along a circumference. This cut is for example advantageously made by means of the pyrotechnic fuse 38 which is fired on the command of the synchronization and command device before the projectile completely enters the building and before the inflation and final positioning of the plugging device 37.

The surface area occupied by the deployed device is also determined so that the plug thus formed remains in the appropriate position irrespective of the nature of the wall 314, shelter roof or industrial roof, on which it is to rest. In particular, the plug must be pressed onto the roof so that the opening made during the penetration of the projectile is properly closed off.

Figure 5:
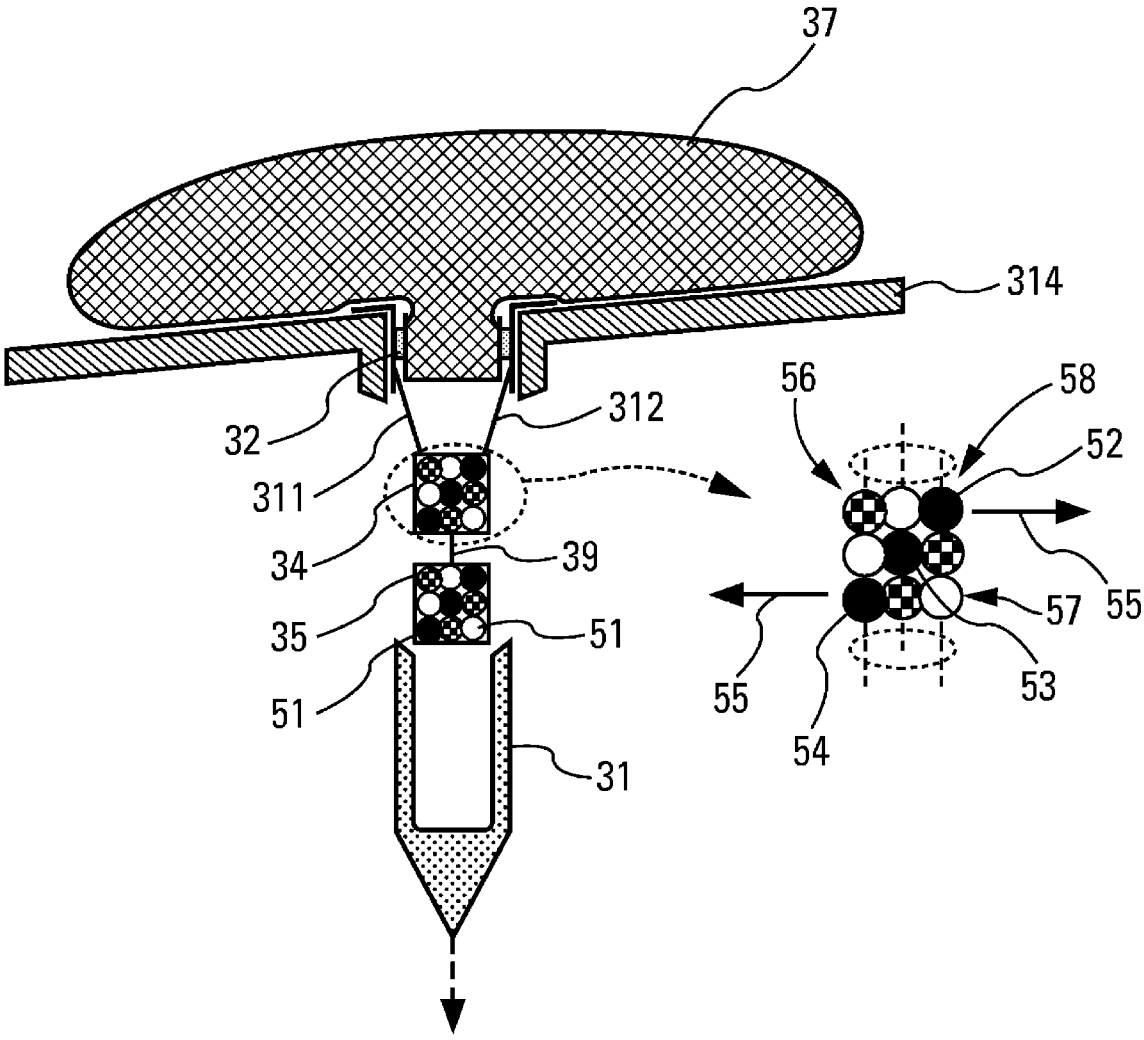

FIG. 5 illustrates schematically the situation obtained at the end of penetration of the projectile. At this moment, the plugging device 37 is fully applied to the wall 314 thereby restoring the initial seal of the building. The sub-munitions 34 and 35 are kept suspended from the ceiling of the building, at a certain distance from the wall 314, forming the roof, determined in particular by the suspension means used. The front portion, that is solid, of the penetrative body 31, for its part, continues freely its course toward the ground.

In an advantageous embodiment, which corresponds to that illustrated by FIG. 5, the projectile according to the invention is designed so that the rear portion 32, that is separated from the rest of the penetrative body, forms a lining of the penetration orifice which prevents contact between the base of the plugging device 37 and the edge of the orifice caused by the penetration, which may have a sharp ridge capable of damaging it. The jacket body therefore provides a mechanical protection for the balloon.

As has been said previously, the sub-munitions 34 and 35 enclose bomblets 51 containing perforating fragments designed to neutralize the containers 112 enclosing the noxious substances that it is sought to destroy. Advantageously, the bomblets 51 are placed inside the sub-munitions 34 and 35 so as to be able to be dispersed in an optimal manner.

In a preferred embodiment, the bomblets are assembled together in spiral strings on three spirals 56, 57 and 58, placed at 120° to one another. The dispersion is therefore achieved spiral by spiral and the bomblets 52, 53 and 54 forming one and the same spiral 58 are dispersed at the same moment in different planes, so that the malfunction of one of the bomblets does not affect the operation of the others.

The synchronization and command device synchronizes the triggering of the bomblets according to a predefined sequence making it possible to obtain the best result in the matter of destroying the containers or barrels containing the noxious materials stored without damaging the building.

In a variant embodiment, the sequencing and command device successively implements two distinct sequences. According to this variant, the main sequence of synchronization is supplemented by a secondary sequence whose role consists in commanding the dispersion and firing of the bomblets placed in reserve during the main sequence. The purpose of this secondary sequence is to disperse a certain number of bomblets designed to prevent the individuals responsible for handling the containers 112 containing the noxious materials from moving the containers remaining intact after the main bombardment.

The sub-munitions being kept high, the projectile according to the invention therefore has the advantage of not requiring any particular device for positioning the sub-munitions 34 and 35 at the desired height. In particular it is not necessary to apply to the sub-munitions, furthermore being relatively fragile, a considerable acceleration designed to compensate for the acceleration sustained by the latter when they follow the trajectory of the penetrative body. Similarly, this hold in a fixed position makes a good dispersion of the bomblets 51 easier, this dispersion being carried out from a stable position, in a substantially horizontal direction 55.

Therefore, as illustrated in FIGS. 3 to 5, the projectile according to the invention has the advantage of simplifying the task of releasing the sub-munitions and of positioning the latter at a height allowing an optimal dispersion of the bomblets. Advantageously, it also makes it possible to solve the problem of the loss of seal following the perforation of the roof of the surrounded building. These two advantages are furthermore obtained irrespective of the thickness and/or the strength of the wall passed through.

Figure 6:
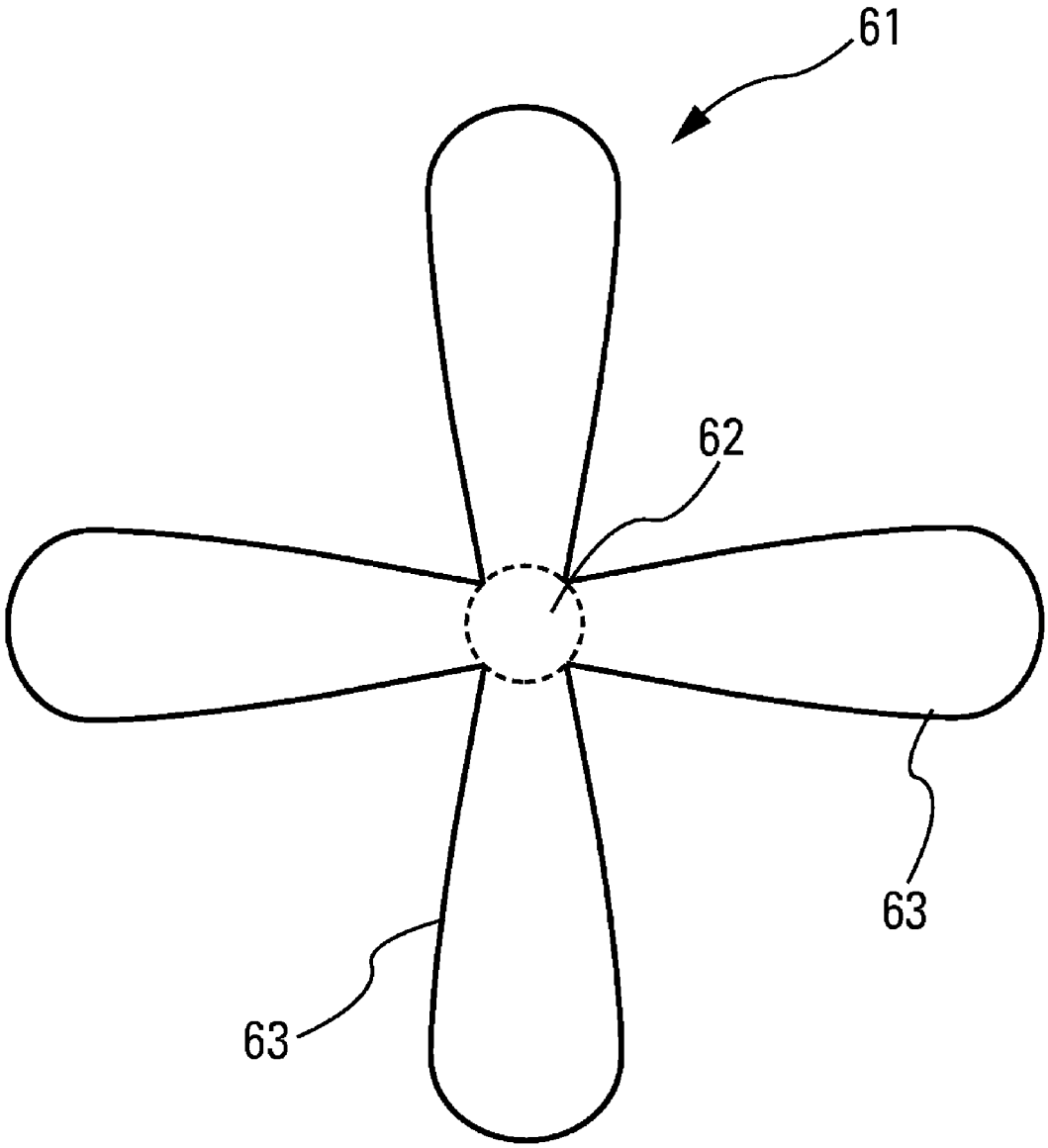

According to the particular embodiment of the projectile according to the invention illustrated by FIGS. 3 to 5, the plugging device 37 is present in the form of a balloon having, after deployment, the approximate shape of a circular plug. This simple shape is in particular well suited to plug an orifice made in a substantially flat wall. Nevertheless, it is possible to use a device having a more complex shape, better suited to the case in which the wall is not flat. For this reason, FIG. 6 presents schematically the top view of a plugging device 61, being shown as a structure having a substantially circular central portion 62, including the base of the device, and extensions 63, in the shape of petals, evenly distributed about the central portion 62. The extensions may for example be three or four in number.

The projectile according to the invention as described through FIGS. 3 to 5 responds in a simple manner to the problem posed. In particular it makes it possible to disperse the load carried in the zone where the containers enclosing the noxious substances to be destroyed are situated, in a manner distributed in space and progressive in time. It also makes it possible to envisage variant embodiments satisfying particular requirements. An advantageous variant embodiment consists for example in using a less solid perforating body, lightening the weight of the penetrative body making it possible for example to increase the weight of the onboard load without modifying the total weight of the projectile. In this variant embodiment, the perforating effect of the projectile may be obtained by fitting this projectile with mini-rockets, triggered by the synchronization and command device when the projectile comes close to the wall to be passed through. In this manner, the wall is destroyed by the effect of the mini-rockets before the projectile penetrates it, and the penetrative body may therefore be substantially less solid and the load transported may be greater. It is possible for example to form a projectile carrying three sub-munitions instead of two.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. A high penetration-power projectile for penetrating a wall of a building by making an entry orifice, said projectile comprising:

a solid ejectable penetrative body: including an internal cavity, said cavity including:

sub-munitions enclosing bomblets with perforating fragments, and a sequencing and command device commanding dispersion and firing of the bomblets, a separable rear portion fixedly attached to the ejectable penetrative body, and forming a jacket body enclosing:

a device for separating the rear portion of the projectile from the penetrative body, whose operation is commanded by the sequencing and command device;

a device for plugging the entry orifice, fixedly attached to the rear portion of the penetrative body; and suspension means for linking the sub-munitions and the device for sequencing and dispersing the bomblets to the rear portion of the penetrative body and configured to keep the sub-munitions and the device for sequencing and dispersing the bomblets suspended from said rear portion.

2. The projectile as claimed in claim 1, wherein the device for separating the rear portion from the penetrative body is a pyrotechnic fuse placed on the periphery which is fired on by a command of the sequencing and command device.

3. The projectile as claimed in claim 2, wherein the device for plugging the entry orifice is an ultra-rapidly inflated balloon fixedly attached to the rear portion of the projectile.

4. The projectile as claimed in claim 3, wherein the device for plugging the entry orifice is an inflatable balloon having substantially a plug-shape.

5. The projectile as claimed in claim 3, wherein the device for plugging the entry orifice is an inflatable balloon having a central portion and extensions in the form of petals uniformly distributed about the central portion.

6. The projectile as claimed in claim 3, wherein the rear portion of the penetrative body lines the entry orifice so as to produce a mechanical protection for the balloon.

7. The projectile as claimed in claim 1, wherein the device for plugging the entry orifice is an ultra-rapidly inflated balloon fixedly attached to the rear portion of the projectile.

8. The projectile as claimed in claim 7, wherein the rear portion of the penetrative body lines the entry orifice so as to produce a mechanical protection for the balloon.

9. The projectile as claimed in claim 1, comprising two sub-munitions, wherein the sequencing and command device carries out a sequential dispersion of the bomblets housed in one and the same sub-munitions, the two sub-munitions being activated separately in sequence.

10. The projectile as claimed in claim 9, wherein the bomblets are arranged inside a sub-munition in three spirals offset by 120°.

11. The projectile as claimed in claim 10 wherein certain bomblets are placed in reserve by the sequencing and command device in order to be activated in a second phase following the phase for activating the other bomblets.

12. The projectile as claimed in claim 1 wherein certain bomblets are placed in reserve by the sequencing and command device in order to be activated in a second phase following the phase for activating the other bomblets.

13. The projectile as claimed in claim 1, further comprising a set of mini-rockets, fired close to the wall to be traversed in order to destroy the material forming the wall in the penetration zone before the penetration of the projectile.

* * * * *